US007012569B2

(12) United States Patent
Gottwald et al.

(10) Patent No.: US 7,012,569 B2
(45) Date of Patent: Mar. 14, 2006

(54) ANTENNA ASSEMBLY

(75) Inventors: Frank Gottwald, Weissach (DE); Klaus Voigtlaender, Wangen (DE); Tore Toennesen, Reutlingen (DE); Andreas Moeller, Reutlingen (DE); Jens Haensel, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 134 days.

(21) Appl. No.: 10/451,445

(22) PCT Filed: Dec. 18, 2001

(86) PCT No.: PCT/DE01/04726

§ 371 (c)(1),
(2), (4) Date: Dec. 22, 2003

(87) PCT Pub. No.: WO02/50952

PCT Pub. Date: Jun. 27, 2002

(65) Prior Publication Data

US 2004/0113840 A1 Jun. 17, 2004

(30) Foreign Application Priority Data

Dec. 20, 2000 (DE) ..... 100 63 437

(51) Int. Cl.
*H01Q 1/38* (2006.01)

(52) U.S. Cl. ..... 343/700 MS

(58) Field of Classification Search ..... 343/700 MS, 343/767, 711

See application file for complete search history.

(56) References Cited

U.S. PATENT DOCUMENTS

| | | | | |
|---|---|---|---|---|
| 3,691,563 A | | 9/1972 | Shelton | 343/771 |
| 5,396,397 A | | 3/1995 | McClanahan et al. | 361/313 |
| 5,896,107 A | * | 4/1999 | Huynh | 343/700 MS |
| 5,970,393 A | * | 10/1999 | Khorrami et al. | 455/129 |
| 6,107,965 A | | 8/2000 | Jochen | 343/700 MS |
| 6,384,785 B1 | * | 5/2002 | Kamogawa et al. | 343/700 MS |

OTHER PUBLICATIONS

Kamogawa, K. et al., "A Novel Microstrip Antenna using Alumina-Ceramic/Polyimide Multilayer Dielectric Substrate", 1996, IEEE MTT-S International Microwave Symposium Digest.

* cited by examiner

*Primary Examiner*—Michael C. Wimer
(74) *Attorney, Agent, or Firm*—Kenyon & Kenyon

(57) ABSTRACT

The present invention provides an antenna array for ascertaining the distance between vehicles and their speed, which includes devices for receiving or transmitting signal waves, a multi-layer carrier situated underneath the devices, a first potential surface, which is at ground and which is situated on the surface of the carrier facing the devices, coupling devices located in the first potential surface, electrical connecting sections disposed as closely as possible underneath the first potential surface, and a second potential surface which is located underneath the connecting sections and is at mass.

26 Claims, 4 Drawing Sheets

ANTENNA ASSEMBLY

FIELD OF THE INVENTION

The present invention is directed to an antenna array and, in particular, to a slot-coupled antenna array for ascertaining the distance between motor vehicles and their speed.

BACKGROUND INFORMATION

Systems have been described in which distance and the speeds are measured by radar (microwaves), especially short-range radar. Currently, radiator-surface antenna arrays (patch antennas) are used, among others, in which radiator surfaces (patches) are mounted directly on substrate materials or on top of foam materials. The radiator surfaces are excited either on the antenna side by feed lines or by coupling slots. The feed lines may be accommodated on an additional material, which is a different material in most cases, and the individual layers or coatings must be interconnected on top of each other. However, these antenna arrays have the disadvantage that the relative adjustment and the precise positioning of the individual material layers is highly complicated and difficult to implement.

Furthermore, antenna arrays have been manufactured according to a so-called triplate technology, in which electric connecting sections are arranged between two metallic coatings. Such antenna arrays are made up, for instance, of individual perforated metal plates, foils with antenna structures or feed lines and of foam intermediate layers. The individual layers are assembled by screw fitting, for example, and secured to prevent slippage. As a result of the fairly complicated design and the involved manufacturing process it requires, such antenna arrays are quite expensive.

Another type of antenna array is set up on a laminated printed-circuit board made up of an FR4 substrate, for example. A so-called softboard is laminated onto the printed circuit board, coupling slots being provided on one side of the softboard. A area is milled out from the FR4-substrate, foam material is inserted in this milled-out surface and the metal radiator surfaces, i.e., patches, are affixed thereon by means of a film, for example. This approach has the disadvantage of requiring a complicated manufacturing method, since holes must be milled out and foams inserted.

In addition, spurious radiation outside the useful frequency occurs in all known arrays, caused by processor pulses, radiation from components etc., for instance, and it is difficult to prevent it. Also, because of feed lines, for example, considerable portions of the useful electromagnetic radiation is radiated in undesired directions, such as in the direction of the vehicle frame or vehicle engine, and may have a detrimental effect on components installed in these areas.

Therefore, the underlying problem definition of the present invention, in general, is to provide an antenna array that has a compact design and reduces an electromagnetic radiation in unwanted directions.

SUMMARY OF THE INVENTION

The antenna array according to the present invention has the advantage that the manufacturing process is facilitated, and more compact sensor and excellent shielding from the electromagnetic energy or from energy waves in unwanted radiation directions are provided.

A compact and easy to manufacture antenna array results from an appropriate arrangement of the electrical connecting sections within the multi-layer carrier between the first potential surface and the second potential surface, as closely as possible underneath the first potential surface. If the connecting sections are correspondingly arranged as closely as possible underneath the first potential surface, the major part of the electromagnetic radiation may be forced upward via the coupling devices, by way of the connecting sections, the same providing a shield toward the bottom in the direction of the second potential surface, so that the radiation occurring beneath the antenna array is low.

According to a further embodiment, at least one coupling device in each case is located at a predefined distance underneath a transmission and receiving device.

According to an additional embodiment, at least one layer of the carrier is situated between the coupling devices and the connecting sections.

In another embodiment, at least one layer of the carrier is situated between the connecting sections and the second potential surface.

According to another embodiment, the at least one layer of the carrier between the coupling devices and the connecting sections has a thickness that is less than that of the at least one layer between the connecting sections and the second potential surface. The at least one layer of the dielectric carrier between the coupling devices and the connecting sections advantageously has approximately one half or one third of the thickness of the at least one layer between the feed lines and the second ground plane. Since layers having a thickness of approximately 150 $\mu$m are advantageously produced for reasons of production engineering, and since these dimensions have an advantageous effect on the resonance characteristics of the array, the carrier may be produced from individual layers having such a thickness. However, the layer thicknesses and the number of individual layers thereon are not restricted to this configuration and may be modified in many ways.

According to an additional embodiment, the transmission and/or receiving devices are embodied as right-angled radiator surfaces (patches). These patches form an advantageous resonator, which is easy to manufacture.

According to another embodiment, the multi-layer dielectric carrier is made of a low-temperature ceramic (LTCC). This ceramic has a high dielectric constant, compact sensors being formed, which are made of a single material system. Moreover, LTCC is adapted to the expansion of silicon, and already at low temperatures (approximately 900° Celsius), a plurality of layers having appropriate structures located thereon is able to be joined by firing in a compact manner.

According to an additional embodiment, the radiator devices are arranged in series, at a certain distance from each other. By an appropriate arrangement, a desired directivity characteristic or radiation direction, radiation power etc. may be achieved.

The coupling devices may be embodied as coupling slots. The coupling slots are provided for an electromagnetic excitation of the radiator surfaces. The coupling slots are advantageously produced by etching the first ground plane and in each case are centrically positioned underneath a radiator surface, each extending approximately across the breadth of a radiator surface. The corresponding dimensions are to be adapted to the desired resonance characteristics.

In another embodiment, the feed lines are formed perpendicularly to the coupling slots in a carrier plane. However, the coupling devices may also be arranged between different carrier planes, thereby reducing mutual interference.

The antenna array may include plated-through holes (contactings) to shield from electromagnetic radiation in a certain area, the plated-through holes being arranged in parallel to each other and perpendicularly to the layer plane of the dielectric carrier, especially between two ground planes. Furthermore, to form shielding chambers, the plated-through holes are advantageously set apart from each other at a distance that is less than the wavelength of the radiation to be shielded from.

The radiator devices may be applied on a suitable foam material.

The radiator devices may be mounted on a housing top of the array. In this way, a compact antenna array consists of only two parts, namely a substrate board and a top on which the radiator devices are mounted.

The feed lines may be electrically connected to a feed-network device located on an upper surface of the carrier by way of at least one contact device in each case. In this way, feed lines between layers of the carrier are controlled by a shared feed-network device, which is easy to mount. However, the supply-network device need not necessarily be affixed on the surface.

Additionally, the reflector devices, the potential surfaces, the connecting sections, the plated-through holes and the contact devices may be made of an electrically conductive material, such as gold, silver, copper or aluminum.

The connecting sections and/or contact devices may also be formed using microstrip and/or coplanar technology. This produces a compact sensor having large-area potential surfaces or ground planes, which are advantageous for shielding.

Additionally, the coupling slots may assume arbitrary forms.

DETAILED DESCRIPTION

Figure 1:
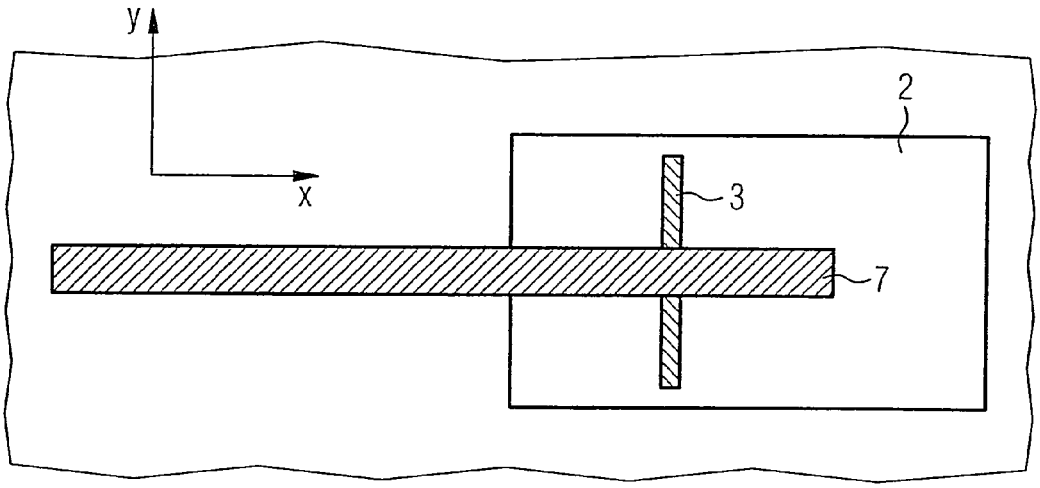
FIG. 1 is a bottom view of the arrangement of a connecting section, a coupling device and a transmission and/or receiving device according to an exemplary embodiment of the present invention.
Figure 2:
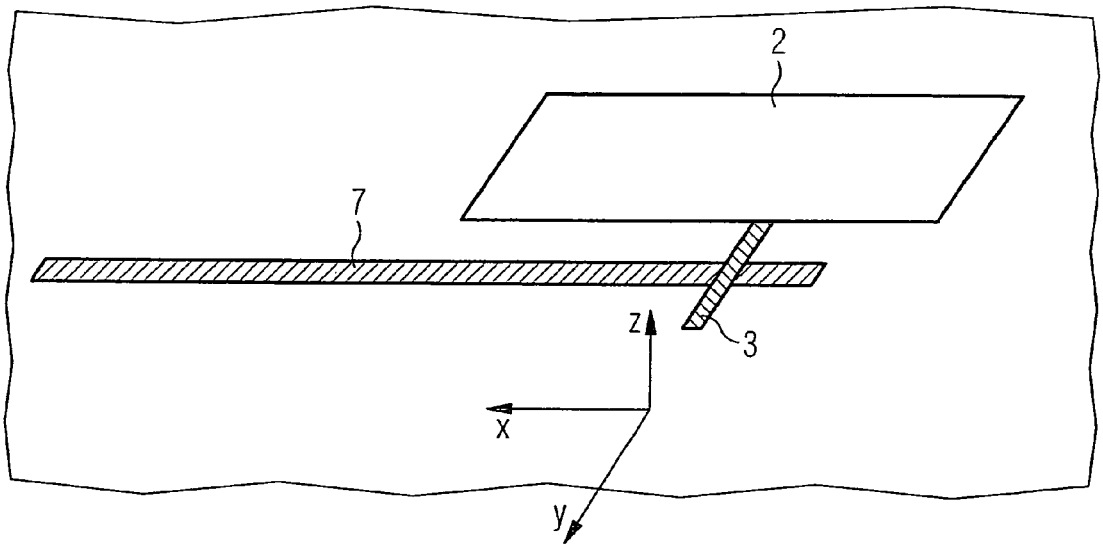
FIG. 2 is a perspective view of the arrangement shown in FIG. 1.

FIGS. 1 and 2 schematically show the arrangement of electrical connecting sections 7, in the form of feed lines 7, coupling devices 3, in the form of coupling slots 3, and transmission and/or receiving devices 2, in the form of radiator surfaces (so-called patches) 2. Such an array is called a slot-coupled patch antenna.

In FIGS. 1 and 2, the dielectric carrier (substrate) 5 and the first and second potential surfaces 4, 10, which are at ground, or ground planes 4, 10 have not been drawn in. The shown radiator surfaces 2 are either applied on a foam material or advantageously affixed on a housing top of the array (not shown).

The principle of a slot-coupled patch antenna will now be briefly discussed on the basis of FIGS. 1 and 2. Feed lines 7 are supplied with electromagnetic energy by a supply network device (not shown). Feed lines 7 are located underneath corresponding coupling slots 3 in such a way that electromagnetic energy is transmitted from supply lines 7 to coupling slots 3. Radiator surfaces 2, located above coupling slots 3, absorb the energy radiated by coupling slots 3 and, given appropriate positioning and extension, are thus brought into resonance. Radiator surfaces 2 therefore reradiate this energy with a certain quality, and it is possible by this arrangement to form a structure that is able to be precisely optimized within a frequency band.

Figure 3:
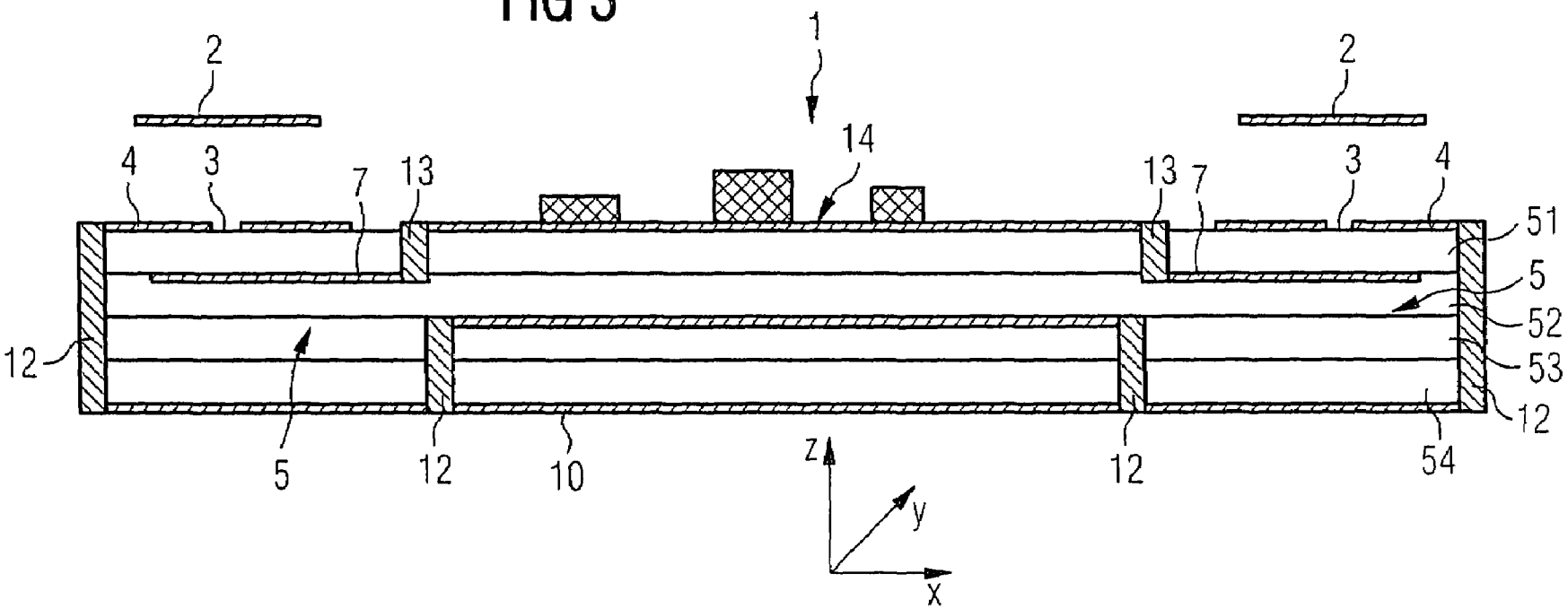
FIG. 3 is a cross-sectional view of an antenna array configured according to a first exemplary embodiment of the present invention.

FIG. 3 represents a cross-sectional view of an antenna array configured according to a first exemplary embodiment of the present invention. Radiator surfaces 2 are fixedly mounted in a housing top (not shown), above dielectric carrier 5, for example.

Carrier 5 consists of a dielectric substrate, which is advantageously made up of an LTCC ceramic (low-temperature co-fired ceramic). This LTCC ceramic is a glass ceramic, suitable for high frequencies and produced in multi-layer technology. As a result, it is especially suited for use in the automotive sector for distance and/or speed measuring using radar in the Gigahertz range. In addition, the ceramic is able to be produced in a plurality of layers with a layer thickness of approximately 150 $\mu$m, for instance, and several layers may be stacked on top of each other. The overall structure may be optimally joined to the carrier plane (xy plane) by firing, already at relatively low temperatures, without this causing a change in geometry. Under high pressure, this glass ceramic shrinks only in the direction of the carrier axis (z-direction). Thus, a compact layer system results, which may be positioned with a high degree of precision.

In addition, the array includes a first ground plane 4, which is arranged on the surface of dielectric carrier 5 facing radiator surfaces 2. One coupling slot is in each case advantageously arranged in this first ground plane 4, at a certain distance underneath radiator surface 2, which is advantageously formed at a right angle. Coupling slots 3 are advantageously produced by etching of first ground plane 4. In addition, they each extend in a centric manner underneath a radiator surface 2, approximately across its breadth, as illustrated in FIG. 1. Coupling slots 3 are advantageously arranged in such a way that upper ground plane 4 is interrupted, each time at a distance of approximately a quarter of the wavelength of the electromagnetic radiation. Thus, by the reflection of the wave at the open end, it is reflected and summed up in correct phase relation with the arriving wave. Consequently, spherical waves are emitted at line 7 below coupling slot 3.

An excitation of coupling slots 3 is produced by electric feed lines 7, which according to the present invention are each situated underneath a coupling slot 3, a dielectric layer 51, having a thickness of approximately 150 $\mu$m, of carrier 5 being arranged between coupling slots 3 and feed lines 7.

For their triggering, feed lines 7 are connected via contact devices 13 to a supply-network device 14, i.e., the high-frequency switching component of the antenna sensor. For better insulation, the multi-layer technology allows feed lines 7 to also be guided in different planes, thereby largely excluding unwanted coupling effects. By guiding feed lines 7 to an upper surface of dielectric carrier 5, it is possible to position the components required for the triggering at a location that is low in radiation.

Furthermore, the antenna array configured according to the present invention has a second ground plane 10 located below feed lines 7, a plurality of layers 52, 53, 54 of dielectric carrier 5 being provided between feed lines 7 and second ground plane 10, the layers having a thickness of 150 μm.

By this asymmetrical tri-plate arrangement, in which feed lines 7 are positioned in closer proximity to coupling slots 3 or first ground plane 4 than they are to second ground plane 10, a higher field intensity is produced in the direction of coupling slots 3 upon excitation of feed lines 7. Therefore, the main portion of the energy is decoupled into the air, via coupling slots 3, and transmitted to the superposed radiator surfaces 2. Due to the greater distance to second ground plane 10, a smaller electric field is produced in this direction and consequently a smaller portion of the energy is radiated in this direction. In this way, the useful radiation, i.e., the portion of the electromagnetic energy in the direction of coupling slots 3 or radiator surfaces 2, is able to be increased.

In the first exemplary embodiment of the present invention, as shown in FIG. 3, only one ceramic layer 51 having a thickness of approximately 150 μm is situated between coupling slots 3 and feed lines 7, whereas three layers 52, 53, 54 each having a thickness of approximately 150 μm are located between the feed lines and lower second ground plane 10. However, it is possible to vary both the number of layers and the thickness of the individual layers according to the desired resonant characteristics or the desired antenna characteristic.

Figure 5:
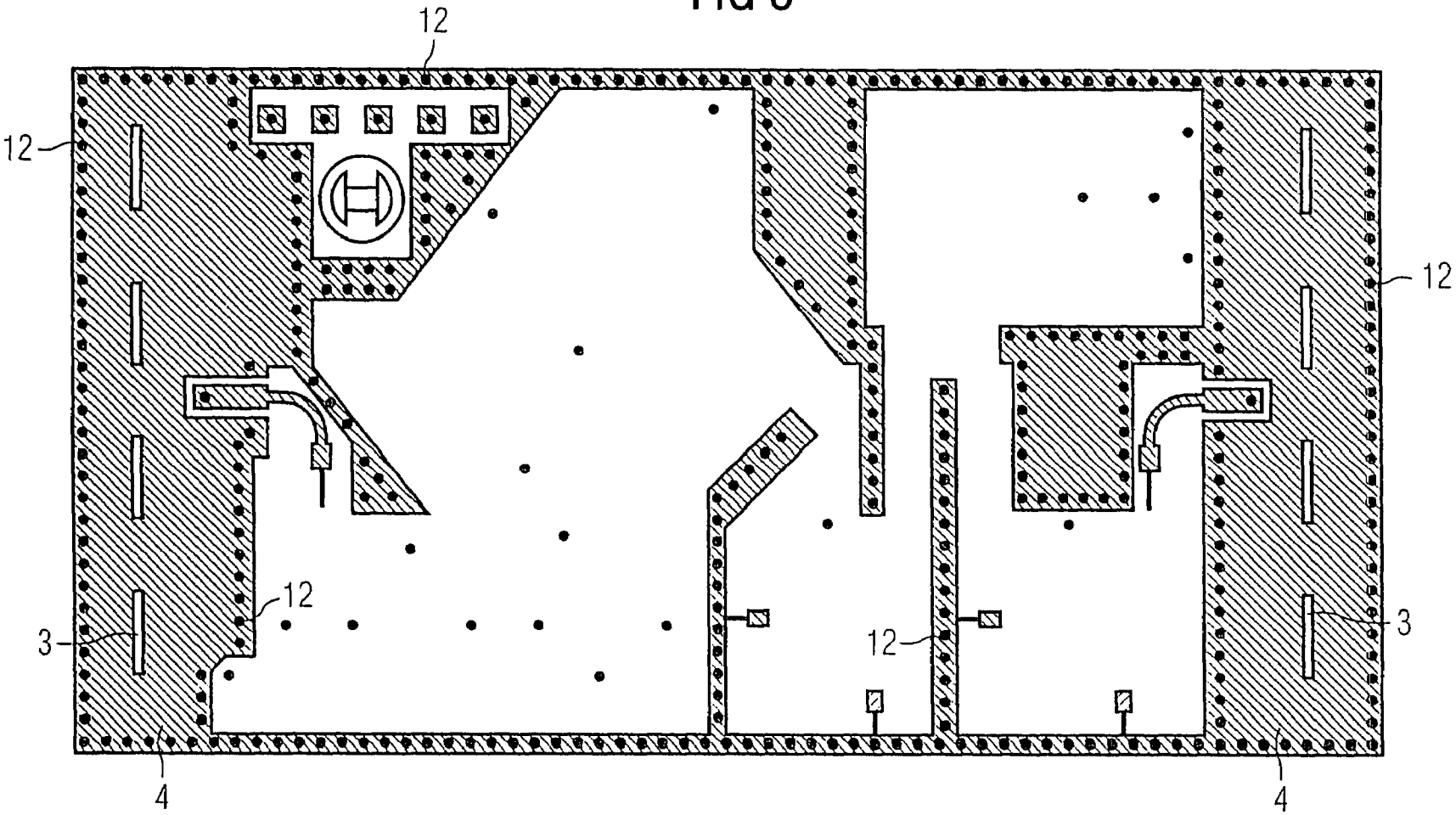
FIG. 5 is a plan view of an antenna array configured according to an exemplary embodiment of the present invention.

By arranging a plurality of radiator surfaces 2 and coupling slots 3 in series, for example at a predefined clearance with respect to each other, as is shown in FIG. 5, it is possible to adapt the desired performance gain, the opening angle and the suppression of secondary lobes to the requirements.

In addition, array 1 advantageously is provided with straight-through or partial plated-through holes 12 which, to shield from electromagnetic radiation, are advantageously located in a certain region, in parallel to each other and vertically in the z-direction of dielectric carrier 5.

Plated-through holes 12 are advantageously spaced apart from each other at a distance that is less than the wavelength of the radiation from which is to be shielded. Incorporating partition walls thus produces an inexpensive electromagnetic shield, since the chambers produced by the plated-through holes prevent the radiation propagating in undesired directions (x-y plane) from spreading in a harmful direction, so that secondary lobes are suppressed.

By a suitable selection of the chambering, the traveling energy may be summed up in correct phase relation with the useful radiation. For instance, a bandwidth of more than 10% of the useful frequency may be generated by positioning a radiator surface 2 at a height that amounts to a twentieth up to a fifth part of the wavelength.

As already mentioned, the supply of antenna array 1 is carried out via an asymmetrical triplate arrangement. Feed lines 7 are located between individual layers, such as first layer 51 and second, third and fourth layers 52, 53, 57 of dielectric carrier 5. Since the components are usually located on the outer surfaces of the carrier, feed lines 7 may be positioned on the corresponding upper surface of carrier 5 through contact devices 13. At that point, microstrip technology is advantageously used. However, to facilitate the shielding measures, the use of a coplanar technology is also an option, as shown in FIG. 5, but adapter networks and/or distribution networks 14 may also be arranged, or buried, inside carrier 5.

Radiator devices 2, ground planes 4, 10, feed lines 7, plated-through holes 12 and contact devices 13 are advantageously made of a material that has good electric conductivity, such as gold, silver, copper or aluminum.

Figure 4:
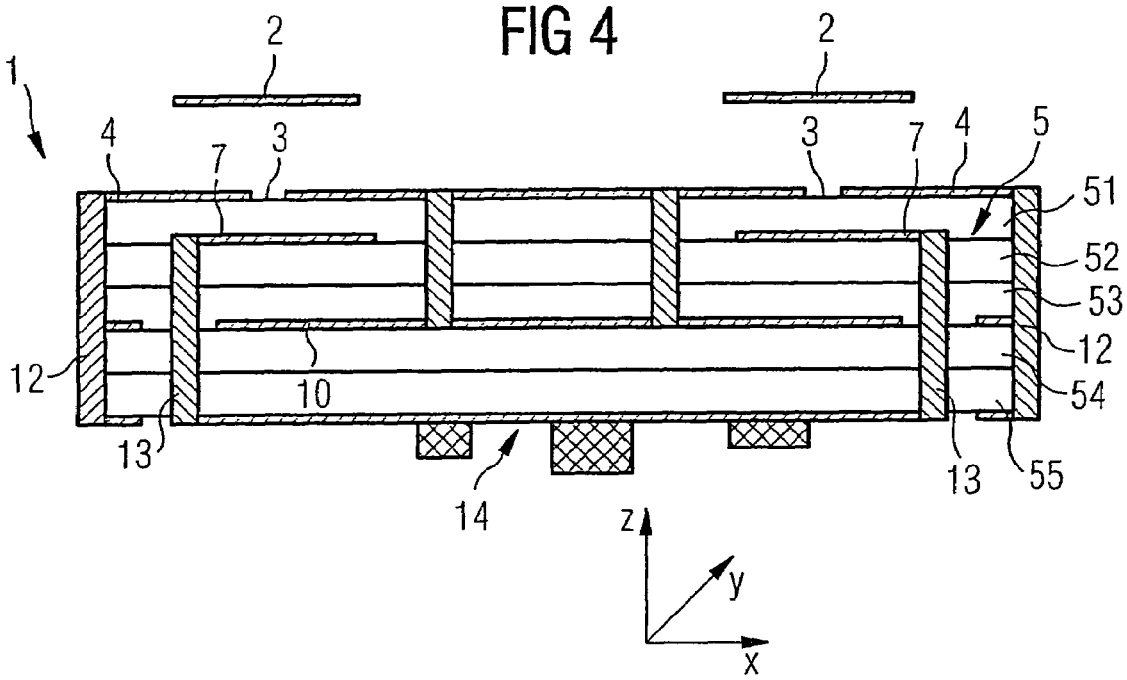
FIG. 4 is a cross-sectional view of an antenna array configured according to a second exemplary embodiment of the present invention.

FIG. 4 represents a cross-sectional view of an antenna array 1 configured according to a second exemplary embodiment of the present invention.

Components or functioning methods not described in this exemplary embodiment are to be regarded as analogous to those of the first exemplary embodiment and therefore do not require any additional discussion.

In contrast to the first exemplary embodiment, supply network device 14, as can be seen from FIG. 4, is located on the surface of carrier 5 facing away from radiator surfaces 2, and therefore is positioned oppositely to the desired direction of radiation. Coupling slots 3 and supply network device 14 are on opposite surfaces of carrier 5. As a result, less space is required, on the one hand, which is advantageous for reasons of design, and the interference of the components due to scattered radiation is reduced, on the other hand.

Via contact devices 13, feed lines 7 are again brought to the surface on which supply network device 14 is located. As shown in FIG. 4, feed lines 7 are therefore guided to the bottom side of carrier 5.

The antenna array is once again embodied as an asymmetrical triplate line in an LTCC ceramic. By appropriate plated-through holes 12, shielded chambers are again produced for additional shielding.

The advantage of this second exemplary embodiment is, in particular, that it reduces the surface of the antenna array, although this goes hand in hand with an increase in thickness, since, compared to the first exemplary embodiment, an additional layer 55 is required in order to continue to avoid undesired resonance effects. However, since the thickness is increased by merely approximately 150 μm as a result of additional layer 55, a savings in length of approximately 1 to 2 cm is obtained, thus producing an antenna that is substantially more compact.

An additional advantage of this area-reducing design is that the antennas, relative to the components of supply network device 14, radiate in the opposite direction and thus do not disturb their functioning method.

Furthermore, as shown in FIG. 4, the antenna side has been provided with a metal coating over the entire surface and includes only coupling slots 3. No further switching components are located on the antenna side, so that an excellent shield is obtained.

By using appropriate plated-through holes 12, additional chambers may be formed, as shown in FIG. 5, to shield from electromagnetic radiation in undesired directions.

Figure 6:
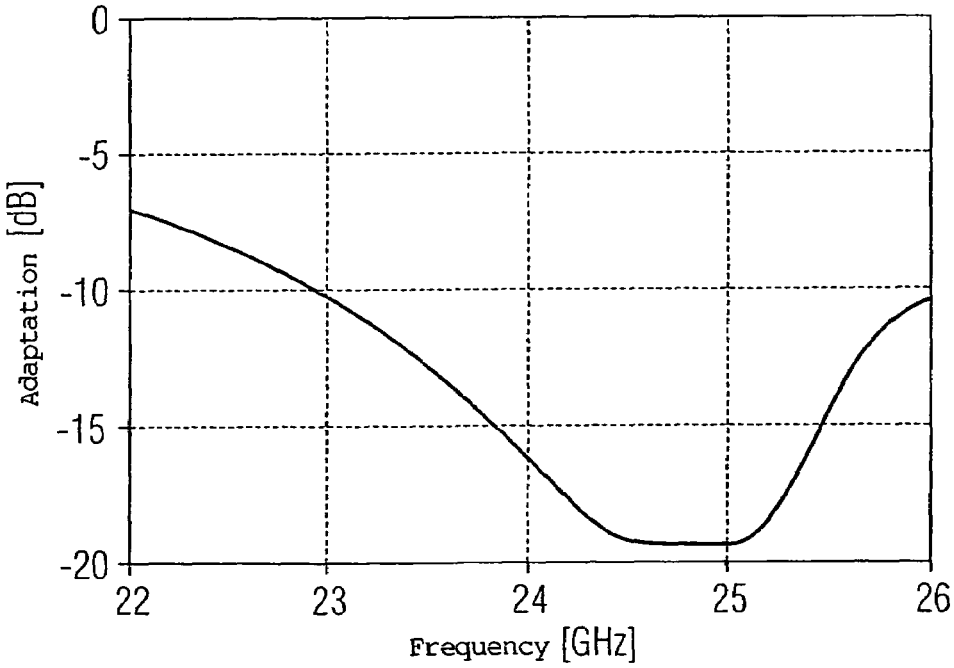
FIG. 6 is a performance diagram of an antenna array, configured according to an exemplary embodiment of the present invention, in a certain frequency range.

FIG. 6 shows a graphic representation of the adaptation, or the back-flow damping, of an antenna array according to the first exemplary embodiment of the present invention. At a mid-frequency of approximately 24 GHz, an adaptation of approximately 20 dB and a bandwidth of approximately 3 GHz result.

The present invention therefore provides a compact sensor, which is made of a small number of different materials, has high capacity in a predefined frequency range as well as clean directivity characteristics and excellent suppression of unwanted radiation in certain directions. Due to the large-area metal-plated ground planes on the upper and lower surface of the carrier, in combination with the asymmetrical triplate arrangement, the major part of the electromagnetic energy is forced to decouple via the coupling slots in the direction of the radiator surfaces. In addition, radiation in the direction of the carrier plane (x-y plane) is prevented because of additional plated-through holes.

Although the present invention was described above in terms of exemplary embodiments, it is not limited thereto, but instead is modifiable in numerous ways.

With the selected arrangement and design, the problems known from the related art do not occur.

For instance, other substrate technologies, such as silicon, gallium arsenide (GaAs), softboard, FR4, ceramics having multi-layer coatings, etc. may be used. Other layer thicknesses, frequency ranges or materials are possible as well.

What is claimed is:

1. An antenna array for ascertaining at least one of a distance between motor vehicles and speeds of the motor vehicles, comprising:

an arrangement for one of receiving and transmitting signal waves;

a multilayer carrier situated underneath the arrangement, the multilayer carrier having an upper surface;

a first potential surface which is at ground and disposed on the upper surface of the multilayer carrier facing the arrangement;

at least one coupling device arranged in the first potential surface at a predefined distance beneath the arrangement, the at least one coupling device including coupling slots each arranged such that the first potential surface is interrupted at a distance of approximately a quarter of a wavelength of electromagnetic radiation;

at least one electrical connecting section positioned in close proximity underneath the first potential surface; and a second potential surface which is at ground and located underneath the at least one electrical connecting section.

2. The antenna array according to claim 1, wherein the least one electrical connecting section is arranged between the first potential surface and the second potential surface between layers of the multilayer carrier such that a major portion of electromagnetic energy to be transmitted is able to be one of decoupled and injected via the at least one coupling device.

3. The antenna array according to claim 2, further comprising:

an arrangement for transceiving signal waves, wherein the at least one coupling device is arranged with a predefined clearance underneath the arrangement.

4. The antenna array according to claim 1, wherein at least one layer of the multilayer carrier is situated between the at least one coupling device and the at least one electrical connecting section.

5. The antenna array according to claim 1, wherein at least one layer of the multilayer carrier is situated between the at least one connecting section and the second potential surface.

6. The antenna array according to claim 5, wherein the at least one layer of the multilayer carrier has a smaller thickness between the at least one coupling device and the at least one electrical connecting section than at least one other layer located between the at least one electrical connecting section and the second potential surface.

7. The antenna array according to claim 6, wherein the thickness of the at least one layer of the multilayer carrier between the at least one coupling device and the at least one electrical connecting section is one of approximately half and approximately a third of the thickness of the at least one other layer between the at least one electrical connecting section and the second potential surface.

8. The antenna array according to claim 1, wherein the arrangement includes a right-angled radiator surface.

9. The antenna array according to claim 1, wherein individual layers of the multilayer carrier include a dielectric ceramic which may be fired at low temperature so that the individual layers melt together.

10. The antenna array according to claim 9, wherein the individual layers of the multilayer carrier each have a thickness of approximately 150 $\mu$m.

11. The antenna array according to claim 1, wherein the arrangement includes devices arranged in series and set apart from each other by a predefined clearance.

12. The antenna array of claim 2, wherein the at least one coupling device includes coupling slots.

13. The antenna array according to claim 12, wherein the coupling slots are etched into the first potential surface.

14. The antenna array according to claim 1, wherein the coupling slots are etched into the first potential surface.

15. The antenna array according to claim 8, wherein the at least one coupling device extends underneath and approximately across a breadth of the right-angled radiator surface.

16. The antenna array according to claim 14, wherein the at least one electrical connecting section inlcudes a feed line in a carrier plane that runs perpendicularly to the coupling slots.

17. The antenna array according to claim 1, further comprising:

vertically extending contactings forming a shield from electromagnetic radiation.

18. The antenna array according to claim 17, wherein the contactings are arranged parallel to each other.

19. The antenna array according to claim 18, wherein the contactings are spaced apart from each other by a distance that is less than a wavelength of the radiation intended to be shielded.

20. The antenna array according to claim 1, further comprising:

a foam layer on which the arrangement is affixed.

21. The antenna array according to claim 1, further comprising:

a housing top on which is affixed the arrangement.

22. The antenna array according to claim 17, further comprising:

a supply network device arranged on a surface of the multilayer carrier; and at least one contacting device;

wherein the at least one electrical connecting section is electrically connected by the at least one contacting device to the supply network device.

23. The antenna array according to claim 22, wherein the arrangement, the first potential surface, the second potential surface, the at least one electrical connecting section, the vertically extending contactings, and the at least one contacting device include an electrically conductive material.

24. The antenna array according to claim 23, wherein the electrically conductive material includes at least one of gold, silver, copper, and aluminum.

25. The antenna array according to claim 22, at least one of the at least one electrical connecting section and the at least one contacting device is formed using at least one of microstrip and coplanar techniques.

26. The antenna array according to claim 12, wherein the coupling slots may be formed as one of a straight line, an H-shape, and a U-shape.

* * * * *

UNITED STATES PATENT AND TRADEMARK OFFICE

CERTIFICATE OF CORRECTION

PATENT NO. : 7,012,569 B2
APPLICATION NO. : 10/451445
DATED : March 14, 2006
INVENTOR(S) : Gottwald et al.

It is certified that error appears in the above-identified patent and that said Letters Patent is hereby corrected as shown below:

Column 1, line 40, change "A area is milled out" to --An area is milled out--

Column 1, line 50, change "radiation is radiated" to --radiation are radiated--

Column 2, line 43, change "a low-temperature ceramic (LTCC)" to --a low-temperature co-fired ceramic (LTCC)--

Column 7, line 34, change "the least one" to --the at least one--

Column 8, line 64, change "and a U-shape." to --or a U-shape.--

Signed and Sealed this

Thirty-first Day of October, 2006

JON W. DUDAS
*Director of the United States Patent and Trademark Office*